US005830614A

United States Patent [19]

Pai et al.

[11] Patent Number: 5,830,614

[45] Date of Patent: Nov. 3, 1998

[54] MULTILAYER ORGANIC PHOTORECEPTOR EMPLOYING A DUAL LAYER OF CHARGE TRANSPORTING POLYMERS

[75] Inventors: Damodar M. Pai, Fairport; William W. Limburg, Penfield; John F. Yanus, Webster; Paul J. DeFeo, Sodus Point, all of N.Y.

[73] Assignee: Xerox Corporation, Stamford, Conn.

[21] Appl. No.: 812,530

[22] Filed: Dec. 20, 1991

[51] Int. Cl.[6] ..... G03G 15/02; G03G 5/02

[52] U.S. Cl. ..... 430/59; 430/96

[58] Field of Search ..... 430/58, 59, 96; 528/203

[56] References Cited

U.S. PATENT DOCUMENTS

| | | | |
|---|---|---|---|
| 4,047,948 | 9/1977 | Horgan . | |
| 4,346,158 | 8/1982 | Pai et al. . | |
| 4,388,392 | 6/1983 | Kato et al. . | |
| 4,588,666 | 5/1986 | Stolka et al. . | |
| 4,801,517 | 1/1989 | Frechet et al. . | |
| 4,806,443 | 2/1989 | Yanus et al. . | |
| 4,806,444 | 2/1989 | Yanus et al. . | |
| 4,818,650 | 4/1989 | Limburg et al. . | |
| 4,871,634 | 10/1989 | Limburg et al. . | |
| 4,889,784 | 12/1989 | Champ et al. | 430/58 |
| 5,028,687 | 7/1991 | Yanus et al. | 528/203 |
| 5,034,295 | 7/1991 | Allen et al. | 430/58 |
| 5,262,512 | 11/1993 | Yanus et al. | 430/59 X |

*Primary Examiner*—M. Nuzzolillo
*Assistant Examiner*—B. P. Codd
*Attorney, Agent, or Firm*—Kenyon & Kenyon

[57] ABSTRACT

This invention relates to a charge transport dual layer for use in a multilayer photoreceptor comprising a support layer, a charge generating layer and a charge transport dual layer including a first transport layer containing a charge-transporting polymer, and a second transport layer containing a charge-transporting polymer having a lower weight percent of charge transporting segments than the charge-transporting polymer in the first transport layer. This structure has greater resistance to corona effects and provides for a longer service life. The charge-transporting polymers preferably comprise polymeric arylamine compounds.

9 Claims, No Drawings

MULTILAYER ORGANIC PHOTORECEPTOR EMPLOYING A DUAL LAYER OF CHARGE TRANSPORTING POLYMERS

FIELD OF THE INVENTION

This invention relates to charge transport dual layers containing charge transporting polymers for use in electrophotographic imaging members.

BACKGROUND OF THE INVENTION

In the art of electrophotography an electrophotographic plate comprising a photoconductive insulating layer on a conductive layer is imaged by first uniformly electrostatically charging a surface of the photoconductive insulating layer. The plate is then exposed to a pattern of activating electromagnetic radiation such as light, which selectively dissipates the charge in illuminated areas of the photoconductive insulating layer while leaving behind an electrostatic latent image in the non-illuminated areas. This electrostatic latent image may then be developed to form a visible image by depositing finely divided electrostatic toner particles on the surface of the photoconductive insulating layer. The resulting visible toner image can be transferred to a suitable receiving material such as paper. This imaging process may be repeated many times with reusable photoconductive insulating layers. The combination of layered materials that photogenerate the charge carriers and conduct them to the surface are collectively referred to either as photoreceptors or as photoconductors.

As more advanced, higher speed electrophotographic copiers, duplicators and printers were developed, degradation of image quality was encountered during cycling. Moreover, complex, highly sophisticated, duplicating and printing systems operating at high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide acceptable toner images over many thousands of cycles. There is also a great current need for long service life, flexible multilayer photoreceptors suitable for compact imaging machines that employ small diameter support rollers for multilayer photoreceptor belt systems compressed into a confined space. Small diameter support rollers are also highly desirable for simple, reliable copy paper stripping systems which utilize the beam strength of the copy paper to automatically remove copy paper sheets from the surface of a multilayer photoreceptor belt after toner image transfer. However, small diameter rollers, e.g. less than about 0.75 inch (19 mm) diameter, raise the threshold of mechanical performance criteria for multilayer photoreceptors to such a high level that spontaneous failure of multilayer photoreceptor belt material becomes common.

One type of multilayer photoreceptor that has been employed as a belt in electrophotographic imaging systems comprises a support layer, a conductive layer, a charge blocking layer, a charge generating layer, and a charge transport layer. The charge transport layer often comprises a small activating molecule dispersed or dissolved in an polymeric film forming binder. Generally, the polymeric film-forming binder in the transport layer is electrically inactive by itself and becomes electrically active only when it contains the activating molecule. The expression "electrically active" means that the material is capable of supporting the injection of photogenerated charge carriers from the material in the charge generating (i. e., photogenerating) layer and is capable of allowing the transport of these charge carriers through the material in order to discharge a surface charge on the active layer. The small activating molecules thus function as charge transporting moieties. The multilayered type of photoreceptor may also comprise additional layers such as an anti-curl backing layer, an adhesive layer, and an overcoating layer. Although excellent toner images may be obtained with multilayer photoreceptors that are developed with dry developer powder (toner), it has been found that these same multilayer photoreceptors become unstable when employed with liquid development systems. Such multilayer photoreceptors suffer from cracking, crazing, crystallization of activating compounds, phase separation of activating compounds and extraction of activating compounds caused by contact with organic carrier fluids, typically isoparaffinic hydrocarbons, e.g. Isopar, commonly employed in liquid developer inks which, in turn, markedly degrade the mechanical integrity and electrical properties of the multilayer photoreceptors. More specifically the organic carrier fluid of a liquid developer tends to leach out small activating molecules, such as the arylamine-containing compounds typically used in the charge transport layers. Representative of this class of materials are: N,N'-diphenyl-N,N'-bis(3-methylphenyl)-[1,1'-biphenyl]-4,4'-diamine; bis-(4-diethylamino-2-methylphenyl)-phenylmethane; 2,5-bis-(4'-dimethylaminophenyl)-1,3,4'-oxadiazole; 1-phenyl-3-(4'-diethylaminostyryl)-5-(4'-diethylaminophenyl)pyrazoline; 1,1-bis-(4-(di-N,N'-p-methylphenyl)-aminophenyl)cyclohexane; 4-diethylaminobenzaldehyde-1,1-diphenylhydrazone; 1,1-diphenyl-2(p-N,N-diphenyl amino phenyl)-ethylene; N-ethylcarbazole-3-carboxaldehyde-1-methyl-1-phenylhydrazone. The leaching process results in crystallization of the small activating molecules, such as the aforementioned arylamine compounds, onto the multilayer photoreceptor surface and subsequent migration of arylamines into the liquid developer ink. In addition, the ink vehicle, typically a $C_{10}$–$C_{14}$ branched hydrocarbon, induces the formation of cracks and crazes in the multilayer photoreceptor surface. These effects lead to copy defects and shortened multilayer photoreceptor life. The degradation of the multilayer photoreceptor manifests itself as increased background and other printing defects prior to complete physical multilayer photoreceptor failure.

The leaching out of the small activating molecule also increases the susceptibility of the transport layer to solvent/stress during periods of non-use. Some carrier fluids also promote phase separation of the small activating molecules, such as arylamine compounds and their aforementioned derivatives, in the transport layers, particularly when high concentrations of the arylamine compounds are present in the transport layer binder. Phase separation of small activating molecules also adversely alters the electrical and mechanical properties of a multilayer photoreceptor. Although flexing is normally not encountered with rigid, cylindrical multilayer photoreceptors which utilize charge transport layers containing small activating molecules dispersed or dissolved in a polymeric film-forming binder, electrical degradation is encountered during development with liquid developers. Sufficient degradation of these multilayer photoreceptors by liquid developers can occur in less than eight hours of use, thereby rendering the multilayer photoreceptor unsuitable for even low quality xerographic imaging purposes.

Multilayer photoreceptors have been developed which comprise charge transfer complexes prepared with polymeric molecules. For example, charge transport complexes formed with polyvinyl carbazole are disclosed in U.S. Pat. Nos. 4,047,948, 4,346,158 and 4,388,392. Multilayer photoreceptors utilizing polyvinyl carbazole layers exhibit relatively poor electrophotographic performance in both electrical and mechanical properties compared to current multilayer photoreceptor performance criteria. Polymeric arylamine molecules prepared by condensation of a di-secondary amine with a di-iodo aryl compound are disclosed in European Patent Publication No. 34,425, published Aug. 26, 1981 and issued May 16, 1984. Since these polymers are extremely brittle and form films which are very susceptible to physical damage, their use in a flexible belt configuration is not practical. Thus, in advanced imaging systems utilizing multilayer photoreceptors exposed to liquid development systems, cracking and crazing have been encountered in active charge transport layers during belt cycling. Cracks developing in charge transport layers during cycling can be manifested as print-out defects adversely affecting copy quality. Furthermore, cracks in the multilayer photoreceptor pick up toner particles which cannot be removed in the cleaning step and which then may be transferred to the background in subsequent prints. In addition, crack areas are subject to delamination when contacted with blade cleaning devices, thus limiting the options in electrophotographic product design.

Multilayer photoreceptors having charge transport layers containing polycarbonates are also known in the art. For example, polycarbonates comprising polymeric arylamine or polymeric acrylamine compounds are disclosed in U.S. Pat. Nos. 4,801,517, 4,806,443, 4,806,444, 4,818,650, 4,871,634, 4,935,487, 4,956,440 and 5,028,687. Unfortunately, multilayer photoreceptors comprised of these materials, while providing improvements over many of the above-noted problems, are prone to degradation in the corona discharge atmospheres typically found in electrophotographic devices.

ADVANTAGES AND SUMMARY OF THE INVENTION

The present invention advantageously provides multilayer photoreceptors having improved resistance to corona atmosphere effects and enabling longer life multilayer photoreceptors.

Another object of the invention is to provide an improved transport layer for multilayer photoreceptors used in electrophotographic imaging equipment.

It is also an object of the present invention to provide improved multilayer photoreceptors containing polymeric arylamine compounds which overcome the other above-noted disadvantages of the prior art.

It is yet another object of the present invention to provide improved multilayer photoreceptors which exhibit greater resistance to cracking and crazing induced by liquid ink carrier fluid.

It is another object of the present invention to provide improved multilayer photoreceptors which exhibit greater resistance to cracking and crazing when mechanically cycled in a belt-type configuration around a narrow diameter roller.

It is a further object of the present invention to provide multilayer photoreceptors which exhibit improved resistance to component leaching during liquid development.

It is still another object of the present invention to provide multilayer photoreceptors which exhibit improved resistance to component crystallization during liquid development.

It is a further object of the present invention to provide multilayer photoreceptors which retain stable electrical properties during cycling.

It is yet another object of the present invention to provide multilayer photoreceptors which exhibit resistance to softening and swelling when exposed to liquid ink carrier fluid.

The charge transport layers employed in current multilayer photoreceptors may be comprised of a molecular dispersion of donor molecules in a binder polymer such as bisphenol A polycarbonate. The charge carrier mobilities in these layers depend on the donor molecule structure and concentration. One way of obtaining high mobility layers is to employ high concentrations of very low ionization potential materials. However, high concentrations and very low ionization potentials each tend to produce devices that are prone to degradation in the corona discharge atmospheres typically found in electrophotographic devices. The degradation in some cases manifests itself as deletions, i.e., increased surface conductivity, and loss of resolution. In theory, these manifestations can be prevented by overcoating such charge transport layers with a small molecule overcoat layer containing a low concentration of a stable molecule. However, that approach is not practical because in the process of overcoating, the top layer homogenizes with the transport layer due to migration of the small molecule charge carriers.

The present invention overcomes this problem by providing a multilayer photoreceptor comprising a support layer, a photogenerating layer and a charge transport dual layer wherein the charge transport dual layer comprises a first transport layer and a second transport layer that is thinner than and deposited on the exposed surface of the first transport layer. Each layer contains a charge-transporting polymer wherein charge transport is provided by active units in the polymer comprising charge transporting segments covalently bound to inactive segments in the polymeric structure. The charge transporting segments may be obtained, for example, from arylamine or acrylamine compounds used to make the polymer. However, the weight percent of charge transporting segments in the charge-transporting polymer of the second transport layer is substantially less than the weight percent of charge transporting segments in the charge-transporting polymer of the first transport layer. The charge transporting segments are the segments that tend to get oxidized in the corona atmosphere. By reducing the concentration of charge transporting segments in the second (top) transport layer, the top layer becomes less prone to degradation while still, surprisingly, being sufficient to leak charge to the surface.

The overall concentration of charge transporting segments in the second transport layer is sufficient to leak the charge without being subject to significant corona degradation effects because the second transport layer is comprised mainly of stable inactive segments that are more resistant to corona degradation effects. The same type of charge transporting segments may be utilized in both the first and second transport layers.

The charge transporting speed, or charge carrier mobility, in the charge transport dual layer is mainly determined by the first transport layer which includes a relatively high weight percent of charge transporting segments.

More specifically, the present invention discloses a multilayer photoreceptor comprising a support layer, a charge generating layer deposited on the support layer and a charge transport dual layer deposited on the charge generating layer; wherein the charge transport dual layer comprises a first transport layer deposited on the charge generating layer, the first transport layer comprising a first charge-transporting polymer including charge transporting segments and inactive segments; and a second transport layer deposited on the first transport layer, the second transport layer comprising a second charge-transporting polymer including charge transporting segments and inactive segments; and wherein the weight percent of charge transporting segments in the second charge-transporting polymer is substantially less than the weight percent of charge transporting segments in the first charge-transporting polymer; and wherein the second transport layer is thinner than the first transport layer.

DETAILED DESCRIPTION OF THE INVENTION

A multilayer photoreceptor of this invention may be prepared by providing a support layer having an electrically conductive surface layer, depositing a charge blocking layer on the electrically conductive surface, depositing a charge generating layer on the blocking layer and depositing a charge transport dual layer on the charge generating layer, wherein the charge transport dual layer is comprised of a first transport layer and a second transport layer deposited on the first transport layer. Preferably the charge generating layer and each layer of the charge transport dual layer includes a polymeric arylamine compound as disclosed in U.S. Pat. Nos. 4,801,517, 4,806,443, 4,806,444, 4,818,650, 4,871,634, 4,935,487, 4,956,440 and 5,028,687, and 5,030,532.

The support layer may be opaque or substantially transparent and may be fabricated from various materials having the requisite mechanical properties. The support layer may comprise electrically non-conductive or conductive, inorganic or organic composition materials. The support layer may be rigid or flexible and may have a number of different configurations such as, for example, a cylinder, sheet, a scroll, an endless flexible belt, or the like. Preferably, the support layer is in the form of an endless flexible belt and comprises a commercially available biaxially oriented polyester known as Mylar™ available from E. I. du Pont de Nemours & Co. or Melinex™ available from ICI. Exemplary electrically non-conducing materials known for this purpose include polyesters, polycarbonates, polyamides, polyurethanes, and the like.

The average thickness of the support layer depends on numerous factors, including economic considerations. A flexible belt may be of substantial thickness, for example, over 200 micrometers, or have a minimum thickness less than 50 micrometers, provided there are no adverse affects on the final multilayer photoreceptor device. In one flexible belt embodiment, the average thickness of the support layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers. The surface of the support layer is preferably cleaned prior to coating to promote greater adhesion of the electrically conductive surface layer. Cleaning may be effected by exposing the surface of the substrate layer to plasma discharge, ion bombardment and the like.

The electrically conductive surface layer may vary in average thickness over substantially wide ranges depending on the optical transparency and flexibility desired for the multilayer photoreceptor. Accordingly, when a flexible multilayer photoreceptor is desired, the thickness of the electrically conductive surface layer may be between about 20 Angstrom units to about 750 Angstrom units, and more preferably from about 50 Angstrom units to about 200 Angstrom units for a preferred combination of electrical conductivity, flexibility and light transmission. The electrically conductive surface layer may be a metal layer formed, for example, on the support layer by a coating technique, such as a vacuum deposition. Typical metals employed for this purpose include aluminum, zirconium, niobium, tantalum, vanadium and hafnium, titanium, nickel, stainless steel, chromium, tungsten, molybdenum, and the like. Useful metal alloys may contain two or more metals such as zirconium, niobium, tantalum, vanadium and hafnium, titanium, nickel, stainless steel, chromium, tungsten, molybdenum, and the like. Regardless of the technique employed to form the metal layer, a thin layer of metal oxide may form on the outer surface of most metals upon exposure to air. Thus, when other layers overlying a (metal) electrically conductive surface layer are described as "contiguous" layers, it is intended that these overlying contiguous layers may, in fact, contact a thin metal oxide layer that has formed on the outer surface of the oxidizable metal layer. An average thickness of between about 30 Angstrom units and about 60 Angstrom units is preferred for the thin metal oxide layers for improved electrical behavior. Generally, for rear erase exposure, a conductive layer light transparency of at least about 15 percent is desirable. The light transparency allows the design of machines employing erase from the rear. The electrically conductive surface layer need not be limited to metals. Other examples of conductive layers may be combinations of materials such as conductive indium-tin oxide as a transparent layer for light having a wavelength between about 4000 Angstroms and about 7000 Angstroms or a conductive carbon black dispersed in a plastic binder as an opaque conductive layer.

After deposition of the electrically conductive surface layer, a hole blocking layer may be applied thereto. Generally, electron blocking layers for positively charged photoreceptors allow holes from the imaging surface of the photoreceptor to migrate toward the conductive layer. For use in negatively charged systems any suitable blocking layer capable of forming an electronic barrier to holes between the adjacent multilayer photoreceptor layers and the underlying conductive layer may be utilized. The blocking layer may be organic or inorganic and may be deposited by any suitable technique. For example, if the blocking layer is soluble in a solvent, it may be applied as a solution and the solvent can subsequently be removed by any conventional method such as by drying. Typical blocking layers include polyvinylbutyral, organosilanes, epoxy resins, polyesters, polyamides, polyurethanes, pyroxyline vinylidene chloride resin, silicone resins, fluorocarbon resins and the like containing an organo-metallic salt. Other blocking layer materials include nitrogen-containing siloxanes or nitrogen-containing titanium compounds such as trimethoxysilyl propylene diamine, hydrolyzed trimethoxysilylpropylethylene diamine, N-beta-(aminoethyl)-gamma-aminopropyltrimethoxy silane, isopropyl-4-aminobenzene sulfonyl, di(dodecylbenzene sulfonyl) titanate, isopropyl-di (4-aminobenzoyl)isostearoyl titanate, isopropyl-tri (N-ethylamino-ethylamino) titanate, isopropyl trianthranil titanate, isopropyl-tri-(N,N-dimethylethylamino) titanate, titanium-4-amino benzene sulfonatoxyacetate, titanium 4-aminobenzoate-isostearate-oxyacetate, $[H_2N(CH_2)_4]$ $CH_3Si(OCH_3)_2$, (gamma-aminobutyl)methyl diethoxysilane, and $[H_2N(CH_2)_3]CH_3Si(OCH_3)_2$ (gamma-aminopropyl)methyldiethoxy silane, as disclosed in U.S. Pat. Nos. 4,291,110, 4,338,387, 4,286,033 and 4,291,110. The blocking layer may comprise a reaction product between a hydrolyzed silane and a thin metal oxide layer formed on the outer surface of the oxidizable (metal) electrically conductive surface. This combination enhances electrical stability at low R.H. The hydrolyzed silane has the general formula:

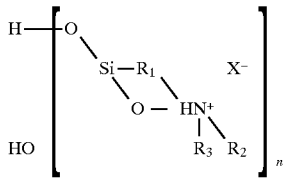

or

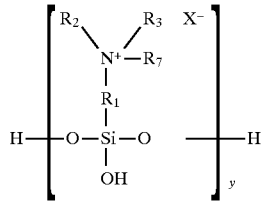

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1, 2, 3 or 4, and y is 1, 2, 3 or 4.

The multilayer photoreceptor is further prepared by depositing on a metal oxide layer of an electrically conductive surface layer, a coating of an aqueous solution of the hydrolyzed aminosilane at a pH between about 4 and about 10, drying the reaction product layer to form a siloxane film and depositing an adhesive layer as described herein, and thereafter depositing electrically operative layers, such as a photogenerating layer and the charge transport layers, to the siloxane film.

The blocking layer should be continuous and usually has an average thickness of less than about 5000 Angstrom units because a greater thickness may lead to undesirable high residual voltage. A blocking layer of between about 50 Angstrom units and about 3000 Angstrom units is preferred because charge neutralization after light exposure of the multilayer photoreceptor is facilitated and improved electrical performance is achieved. The blocking layer may be applied by a suitable technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by techniques such as by vacuum, heating and the like. Generally, a weight ratio of blocking layer material and solvent of between about 0.05:100 and about 0.5:100 is satisfactory for spray coating. A suitable siloxane coating is described in U.S. Pat. No. 4,464,450.

If desired, an adhesive layer may be applied to the hole blocking layer. Typical adhesive layers include a polyester resin such as Vitel PE-100™, Vitel PE-200™, Vitel PE-200™, and Vitel PE-222™, all available from Goodyear Tire and Rubber Co., polyvinyl butyral, duPont 49,000 polyester, and the like. When an adhesive layer is employed, it should be continuous and, preferably, have a average dry thickness between about 200 Angstrom units and about 900 Angstrom units and more preferably between about 400 Angstrom units and about 700 Angstrom units. Suitable solvent or solvent mixtures may be employed to form a coating solution of the adhesive layer material. Typical solvents include tetrahydrofuran, toluene, methylene chloride, cyclohexanone, and mixtures thereof. Generally, to achieve a continuous adhesive layer dry thickness of about 900 Angstroms or less by gravure coating techniques, the preferred solids concentration is about 2 percent to about 5 percent by weight based on the total weight of the coating mixture of resin and solvent. However, techniques may be utilized to mix and thereafter apply the adhesive layer coating mixture to the charge blocking layer. Typical application techniques include spraying, dip coating, roll coating, wire wound rod coating, and the like. Drying of the deposited coating may be effected by a suitable technique such as oven drying, infra red radiation drying, air drying and the like.

A charge generating layer is applied to the blocking layer, or adhesive layer if one is employed, which can then be overcoated with a contiguous charge transport dual layer as described herein. Examples of charge generating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine described in U.S. Pat. No. 3,357,989, metal phthalocyanines such as vanadyl phthalocyanine, titanyl phthalocyanines and copper phthalocyanine, quinacridones available from DuPont under the trade name Monastral Red™, Monastral Violet™ and Monastral Red Y™. Vat Orange 1™ and Vat Orange 3™ are trade names for dibromoanthrone pigments, benzimidazole perylene, substituted 3,4-diaminotriazines disclosed in U.S. Pat. No. 3,442,781, polynuclear aromatic quinones available from Allied Chemical Corporation under the tradename Indofast Double Scarlet™, Indofast Violet Lake B™. Indofast Brilliant Scarlet™ and Indofast Orange™, and the like dispersed in a film forming polymeric binder. Selenium, selenium alloy, benzimidazole perylene, and the like and mixtures thereof, may be formed as a continuous, homogeneous charge generating layer. Benzimidazole perylene compositions are well known and described, for example, in U.S. Pat. No. 4,587,189. Multiphotogenerating layer compositions may be utilized wherein an additional photoconductive layer may enhance or reduce the properties of the charge generating layer. Examples of this type of configuration are described in U.S. Pat. No. 4,415,639. Other suitable charge generating materials known in the art may also be utilized, if desired. Charge generating binder layers comprising particles or layers including a photoconductive material such as vanadyl phthalocyanine, titanyl phthalocyanines, metal-free phythalocyanine, benzimidazole perylene, amorphous selenium, trigonal selenium, selenium alloys such as selenium-tellurium, selenium-tellurium-arsenic, selenium arsenide and the like, and mixtures thereof, are especially preferred because of their sensitivity to white light. Vanadyl phthalocyanine, titanyl phthalocyanines, metal free phthalocyanine and tellurium alloys are also preferred because these materials provide the additional benefit of being sensitive to infra-red light.

Numerous inactive resin materials may be employed in the charge generating binder layer including those described, for example, in U.S. Pat. No. 3,121,006. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, and the like. These polymers may be block, random or alternating copolymers.

An active transporting polymer containing charge transporting segments may also be employed as the binder in the charge generating layer. These polymers are particularly useful where the concentration of carrier-generating pigment particles is low and the average thickness of the carrier-generating layer is substantially thicker than about 0.7 micrometer. The active polymer commonly used as a binder is polyvinylcarbazole whose function is to transport carriers which would otherwise be trapped in the layer.

Electrically active polymeric arylamine compounds can be employed in the charge generating layer to replace the polyvinylcarbazole binder or another active or inactive binder. Part or all of the active resin materials to be employed in the charge generating layer may be replaced by electrically active polymeric arylamine compounds.

The photogenerating composition or pigment is present in the resinous binder composition in various amounts, generally, however, from about 5 percent by volume to about 90 percent by volume of the photogenerating pigment is dispersed in about 95 percent by volume to about 10 percent by volume of the resinous binder, and preferably from about 20 percent by volume to about 30 percent by volume of the photogenerating pigment is dispersed in about 80 percent by volume to about 70 percent by volume of the resinous binder composition. In one embodiment about 8 percent by volume of the photogenerating pigment is dispersed in about 92 percent by volume of the resinous binder composition.

For embodiments in which the charge generating layers do not contain a resinous binder, the charge generating layer may comprise any suitable, well known homogeneous photogenerating material. Typical homogenous photogenerating materials include inorganic photoconductive compounds such as amorphous selenium, selenium alloys selected such as selenium-tellurium, selenium-tellurium-arsenic, and selenium arsenide and organic materials such as benzamidazole pevylene, vanadyl phthalocyanine, chlorindium phthalocyanine, chloraluminum phthalocyanine, and the like.

The charge generating layer containing photoconductive compositions and/or pigments and the resinous binder material generally ranges in average thickness from about 0.1 micrometer to about 5.0 micrometers, and preferably has a average thickness from about 0.3 micrometer to about 3 micrometers. The charge generating layer thickness is related to binder content. Higher binder content compositions generally require thicker layers for photogeneration. Thicknesses outside these ranges can be selected providing the objectives of the present invention are achieved.

The charge transport dual layer of the present invention is applied to the charge generating layer by first depositing the first charge transport layer to the charge generating layer and then depositing the second, thinner charge transport layer to the first charge transport layer. Each layer of the charge transport dual layer may comprise any conventional charge transport polymer material. Preferably each layer of the charge transport dual layer comprises a polymeric arylamine compound.

Typical polymeric arylamine compounds include, for example, the polymeric reaction product formed by reacting N,N'-diphenyl N,N'bis(3-hydroxyphenyl)-(1,1'-biphenyl)-4,4'diamine with diethylene glycol bis-chloroformate, a copolymer formed by reacting N,N'-bis(3-(2-hydroxyethyl) phenyl aniline and 4,4'-isopropylidene diphenol, ("bisphenol A"), with diethylene glycol bischloroformate, a copolymer formed by reacting N,N'-diphenyl-N,N'-bis[3-(2-hydroxyethyl)]phenyl-1,1'-biphenyl-4,4'diamine and bisphenol A with diethylene glycol bischloroformate, or a copolymer formed by reacting N,N'-bis,3-hydroxphenyl(1,1'-biphenyl) 4,4'diamine and bisphenol A with diethylene glycol bischloroformate.

Preferred polymeric arylamine compounds have a molecular weight from about 5000 to about 1,000,000, more preferably, from about 50,000 to about 500,000.

These and other transporting polymers are described in U.S. Pat. Nos. 4,801,517; 4,806,443; 4,806,444; 4,818,650; 4,871,634; 4,935,487; 4,956,440 and 5,028,687.

Materials such as the polymeric arylamine compounds are capable of supporting the injection of photogenerated holes from the charge generating layer and allowing the transport of these holes through the charge transport dual layer to selectively discharge the surface charge. When the charge generating layer is sandwiched between the conductive layer and the active charge transport dual layer, the charge transport dual layer not only serves to transport holes, but also serves to protect the charge generating layer from abrasion or chemical attack and therefore serves to extend the operating life of the multilayer photoreceptors. As disclosed in the present invention, the second, thinner layer of the charge transport dual layer serves to provide protection against degradation effects of the corona atmosphere over many electrophotographic cycles. The charge transport dual layer should exhibit negligible, if any, absorption and photodischarge when exposed to a wavelength of light useful in electrophotography, e.g., 4000 Angstroms to 9000 Angstroms. Therefore, the charge transport dual layer is substantially transparent to radiation in a region in which the photoconducting charge generating layers are to be used. Thus, the charge transport dual layer support the injection of photogenerated holes from photoconductors in the charge generating layer. To ensure that most of the incident radiation is utilized by the underlying charge generating layer for efficient photogeneration, the charge transport dual layer is normally transparent when exposure is effected through the charge transparent layer. When used with a transparent substrate, imagewise exposure may be accomplished through the substrate with all light passing through the substrate. The charge transport dual layer and the charge generating layer are insulators to the extent that an electrostatic charge placed on a transport layer is not conducted in the absence of illumination.

Part or all of the charge transport material comprising the charge transport dual layer may be active materials comprising a polymeric arylamine film-forming material. Any substituents in the polymeric arylamine compound should be free from electron withdrawing groups such as —$NO_2$ groups, —CN groups, and the like.

Suitable solvents may be employed to apply the materials of the charge transport dual layer to the underlying layer.

Typical solvents include methylene chloride, toluene, tetrahydrofuran, and the like. Methylene chloride solvent is a particularly desirable component for adequate dissolving of all the components of a charge transport layer coating mixture and for its low boiling point.

An especially preferred first transport layer of this invention comprises the polymeric reaction product formed by reacting N,N'diphenyl-N,N'-bis(3-hydroxyphenyl)-(1,1'-biphenyl)-4,4'diamine with diethylene glycol bis-chloroformate.

An especially preferred second transport layer comprises a copolymer formed by reacting N,N'-bis,3-hydroxphenyl (1,1'-biphenyl) 4,4'diamine and 4,4'-isopropylidene diphenol with diethylene glycol bischloroformate, wherein the copolymer formed has a lower concentration of charge transporting segments than is present in the first transporting layer.

Suitable techniques may be utilized to mix and thereafter apply the coating mixtures of the charge transport dual layer to the underlying surface. Typical application techniques include spraying, dip coating, roll coating, wire rod coating, and the like. Drying of the deposited coating may be effected by a suitable technique such as oven drying, infra red radiation drying, air drying and the like.

Generally, the average thickness of the first charge transport layer is between about 5 to about 100 micrometers, but average thicknesses outside this range can also be used. In general, the ratio of the average thickness of the first charge transport layer to the average thickness of the charge generating layer is preferably maintained from about 2:1 to about 200:1 and in some instances is as great as about 400:1.

Generally, the average thickness of the second, thinner transport layer is between about 1 to about 5 micrometers, but average thicknesses outside this range can also be used. In general, the ratio of the average thickness of the second, thinner transport layer to the average thickness of the first transport layer is preferably maintained from about 0.01 to 0.1 and in some instances as great as 0.2.

Preferably, the weight percent of charge transporting segments in the charge transporting polymer in the first transport layer is from about 30 percent to about 90% of the total polymer weight. Preferably the weight percent of charge transporting segments in the charge transporting polymer in the second transport layer is from about 5 percent to about 30 percent of the total polymer weight.

Other layers such as conventional ground strips comprising, for example, conductive particles dispersed in a film-forming binder may be applied to one edge of the multilayer photoreceptor in contact with the conductive surface, blocking layer, adhesive layer or charge generating layer.

In some cases a back coating may be applied to the side opposite the multilayer photoreceptor to provide flatness and/or abrasion resistance. This backcoating layer may comprise an organic polymer or inorganic polymer that is electrically insulating or slightly semi-conductive.

The multilayer photoreceptor of the present invention may be employed in any suitable and conventional electrophotographic imaging process which utilizes charging prior to imagewise exposure to activating electromagnetic radiation. Conventional positive or reversal development techniques may be employed to form a marking material image on the imaging surface of the electrophotographic imaging member of this invention.

Thus, by applying a suitable electrical bias and selecting toner having the appropriate polarity of electrical charge, one may form a toner image in the negatively charged areas or discharged areas on the imaging surface of the electrophotographic member of the present invention. More specifically, for positive development, charged toner particles of one polarity are attracted to the oppositely charged electrostatic areas of the imaging surfaces and for reversal development, charged toner particles are attached to the discharged areas of the imaging surface. Where the charge generating layer is sandwiched between a charge transport layer and a conductive surface, a negative polarity charge is normally applied prior to imagewise exposure to activating electromagnetic radiation.

The multilayer photoreceptor of the present invention exhibits greater resistance to cracking, crazing, crystallization of arylamine compounds, phase separation of arylamine compounds and leaching of arylamine compounds during cycling and is particularly suitable for providing greater resistance to corona degradation effects.

This invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

Following the procedure of Example I in U.S. Pat. No. 4,588,666, N,N'-di(3-methoxyphenyl)-N,N'-diphenyl-[1,1'-biphenyl]-4,4'diamine was synthesized from m-iodoanisole to achieve a yield of 90 percent, m.p. 120°–125° C.

EXAMPLE II

N,N'-diphenyl-N,N'-bis(3-hydroxyphenyl)-(1,1'-biphenyl)-4,4'-diamine was prepared, for example, from N,N'-di(3-methoxyphenyl)-N,N'-diphenyl-[1,1'-biphenyl]-4,4'diamine by placing into a two liter three-necked round bottom flask, equipped with a mechanical stirrer and an argon gas inlet, 137.5 gms, N,N'-diphenyl-N,N'-bis(3-methoxy phenyl)-[1,1'-biphenyl]-4,4'diamine (0.25 moles), 223.5 gms anhydrous sodium iodide (1.5 moles) and 500 milliliters warm sulfolane (distilled). The contents of the flask were heated to 120° C. and then cooled to 60° C. Five milliliters of D.I. water was added dropwise, followed by 190.5 milliliters of trimethyl(chlorosilane) (1.5 moles). The contents were allowed to reflux for six hours. HPLC analysis was utilized to determine when the reaction was complete. The contents of the flask were poured into a 3 liter Erlenmeyer flask containing 1.5 liter of deionized water. The water layer was decanted and the dark oily residue taken up into 500 milliliters methanol. The methanol solution was extracted with two 400 milliliter portions of hexane to remove the hexamethyldisiloxane by-products. The methanol solution was roto-evaporated to remove the solvents. The residue was taken up in 500 milliliters of acetone and then precipitated into 1.5 liters deionized water. The off-white solid was filtered and then washed with deionized water and dried in vacuo. The crude N,N'diphenyl-N,N'-bis (3-hydroxyphenyl)-(1,1'-biphenyl)-4,4'-diamine was placed into a two liter round-bottom flask containing a magnetic stirrer and one liter toluene. Fifty gms. of Florisil® (Florisil is a registered trademark of Floridin Co.) was added to the flask and allowed to stir for two hours. The dark Florisil® was filtered off, leaving a pale yellow toluene solution. The toluene was roto-evaporated to yield a pale yellow viscous oil. The oily product was dissolved in 400 milliliters acetone, then diluted with 400 milliliters heptane and allowed to crystallize. The colorless crystals were filtered. Additional product was obtained by roto-evaporating the acetone from the filtrate. Yield was 85 percent, m.p. 113°–17° C.

EXAMPLE III

Into a 500 milliliter three-necked round bottom flask equipped with a mechanical stirrer, an argon gas inlet and a dropping funnel was placed 26 grams N,N'diphenyl-N,N'-bis(3-hydroxyphenyl)-(1,1'biphenyl)-4,4'diamine (0.05 moles), 200 milliliters dry tetrahydrofuran, and 21 milliliters triethylamine (0.15 moles). The flask was cooled with a water bath while adding dropwise 8.4 milliliters (0.15 moles) diethylene glycol bischloroformate in 40 milliliters dry tetrahydrofuran. A colorless precipitate of triethylamine hydrochloride was formed almost immediately. After 30 minutes, the addition was complete and the visous mixture allowed to stir for 15 minutes. Approximately 0.2 gram phenol in 10 milliliters of dry tetrahydrofuran was added to the polymer mixture and allowed to stir for 5 minutes. The polymer solution was filtered to remove the triethylamine hydrochloride. The colorless polymer solution was precipitated into methanol, filtered and dried. The yield was 29 grams and the molecular weight was 310,000. In this polymer the weight percent of charge transport segments is about 72% of the total polymer weight and the weight percent of inactive segments is about 28%.

EXAMPLE IV

Into a 500 milliliter three-necked round bottom flask equipped with a mechanical stirrer, an argon gas inlet and a dropping funnel was placed 2.3 grams N,N'diphenyl-N,N'-bis(3-hydroxyphenyl)-(1,1'biphenyl)-4,4'diamine (0.0045 moles), 10.4 grams 4,4'-isopropylidene diphenol (0.0455 moles), 200 milliliters dry tetrahydrofuran and 21 milliliters triethylamine (0.15 moles). The flask was cooled with a water bath while adding dropwise 8.4 milliliters (0.15 moles) diethylene glycol bischloroformate in 40 milliliters dry tetrahydrofuran. A colorless precipitate of triethylamine hydrochloride was formed almost immediately. After 30 minutes, the addition was complete and the viscous mixture was stirred for 15 minutes. Approximately 0.2 gram phenol in 10 milliliters of dry tetrahydrofuran was added to the polymer mixture and allowed to stir for 5 minutes. The polymer solution was filtered to remove the triethylamine hydrochloride. The colorless polymer solution was precipitated into methanol, filtered and dried. The yield was 15 grams and the molecular weight was 110,000. In this polymer the weight percent of charge transport segments is about 10% of the total polymer weight and the weight percent of inactive segments is about 90%

EXAMPLE V

Two electrophotographic imaging members were prepared by forming coatings using conventional coating techniques on a substrate comprising vacuum deposited titanium layer on a polyethylene terephthalate film (Melinex®, available from ICI). The first coating was a siloxane barrier layer formed from hydrolyzed gamma aminopropyltriethoxysilane having a thickness of 0.005 micrometer (50 Angstroms). This film was coated as follows: 3-aminopropyltriethoxysilane (available from PCR Research Chemicals of Florida) was mixed in ethanol in a 1:50 volume ratio. The film was applied to a wet thickness of 0.5 mil by a multiple clearance film applicator. The layer was then allowed to dry for 5 minutes at room temperature, followed by curing for 10 minutes at 110 degree centigrade in a forced air oven. The second coating was an adhesive layer of polyester resin (49,000, available from E. I. duPont de Nemours & Co.) having a thickness of 0.005 microns (50 Angstroms) and was coated as follows: 0.5 grams of 49,000 polyester resin was dissolved in 70 grams of tetrahydrofuran and 29.5 grams of cyclohexanone. The film was coated by a 0.5 mil bar and cured in a forced air oven for 10 minutes. The next coating was a charge generator layer containing 35 percent by weight vanadyl phthalocyanine particles obtained by the process as disclosed in U.S. Pat. No. 4,771,133 of Liebermann et al., issued Sep. 13, 1988, dispersed in a polyester resin (Vitel PE 100, available from Goodyear Tire and Rubber Co.) having a thickness of 1 micrometer.

EXAMPLE VI

The first of the two generator layers of Example V was coated with a 25 micron thick transport layer of polyether carbonate. The polyether carbonate resin was prepared as described in Example III (also Example III of U.S. Pat. No. 4,806,443). It was accomplished by dissolving one gram of the polymer of Example III into nine grams of methylene chloride and coating a 25 micron film with bar coating. The film was dried in a forced air oven at 100° C. for 20 minutes.

EXAMPLE VII

The second of the two generator layers of Example V was coated with two transport layers. The first transport layer was a 20 micron thick film of polyether carbonate. The polyether carbonate resin was prepared as described in Example III (also example III of U.S. Pat. No. 4,806,443). The device with the first transport layer was dried in a forced air oven at 100° C. for 20 minutes. The second transport layer was a 5 micron thick film of polymer whose synthesis is described in Example IV. It was accomplished by dissolving one gram of the polymer of Example IV in nine grams of toluene and coating a 5 micron film with bar coating. The film was dried in a forced air oven at 100° C. for 20 minutes.

EXAMPLE VIII

The devices described in Example VI and VII were mounted on a cylindrical aluminum drum which was rotated on a shaft. The films were charged by a corotron mounted along the circumference of the drum. The surface potentials were measured as a function of time by several capacitively coupled probes placed at different locations around the shaft. The probes were calibrated by applying known potentials to the drum substrate. The films on the drum were exposed and erased by light sources located at appropriate positions around the drum. The measurement consisted of charging the photoconductor devices in a constant current or voltage mode. As the drum rotated, the initial charging potential was measured by probe 1. Further rotation led to the exposure station, where the photoconductor device were exposed to monochromatic radiation of known intensity. The surface potential after exposure was measured by probes 2 and 3. The devices were finally exposed to an erase lamp of appropriate intensity and any residual potentials were measured by probe 4. The process was repeated with the magnitude of the exposure automatically changed during the next cycle. A photo induced discharge characteristics curve was obtained by plotting the potentials at probes 2 and 3 as a function of exposure. Good sensitivities were observed in both the visible range (400–650 nanometers) and infrared range (700–780 nanometers). The optimum light energy required to generate a maximum contrast of 600 volts for 1.0 neutral density image was found to be 15 ergs/cm$^2$ in the visible and 10 ergs/cm$^2$ in the infrared range for both devices. The devices were cycled continuously for 10,000 cycles of charge, expose and erase steps and found to have stable potentials during charging, after exposure and following erase steps.

EXAMPLE IX

The following test was carried out on devices in Examples VI and VII to check their surface stability against corona degradation. A negative corotron was operated (with the high voltage on) opposite a grounded electrode for several hours. The high voltage was turned off, and the corotron was placed (or parked) for thirty minutes on a unit of the devices in Examples VI and VII. Only a short unit of the devices was thus exposed to the effluents. Unexposed regions on either side of the exposed region were used as control. The devices were then tested in a scanner for its positive charge acceptance properties. A conducting surface region (excess hole concentration) appeared as a loss of positive charge acceptance and increased dark decay in the exposed areas (compared to the unexposed control areas on either side). Since the conducting region was on the surface, a negative charge acceptance scan was not affected by the corona effluent exposure (negative charges do not move through the transport layer). Substantial improvement was seen in the ability of device in Example VII (in comparison to the device in Example VI) to withstand the effluents from the parked corotron. This was seen in the positive charge acceptance of the device following exposure to a parked corona. The device in Example VII charged to 600 volts with a dark decay of 100 volts in 3 seconds; however the device in Example VI charged to less than 200 volts which decayed to zero volts in three seconds.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A multilayer photoreceptor comprising:

a support layer, a charge generating layer deposited on the support layer and a charge transport dual layer deposited on the charge generating layer;

wherein the charge transport dual layer comprises a first transport layer deposited on the charge generating layer, the first transport layer comprising a first charge-transporting polymer including charge transporting segments and inactive segments, wherein the first charge-transporting polymer comprises a polymeric arylamine compound; and a second transport layer deposited on the first transport layer, the second transport layer comprising a second charge-transporting polymer including charge transporting segments and inactive segments, wherein the second charge-transporting polymer comprises a polymeric arylamine compound; and wherein the weight percent of charge transporting segments in the first charge transporting polymer is in the range from about 30 to about 90 weight percent of the total polymer weight and wherein the weight percent of charge transporting segments in the second charge-transporting polymer is in the range from about 5 to about 30 weight percent of the total polymer weight; and wherein the second transport layer is thinner than the first transport layer.

2. The multilayer photoreceptor of claim 1 wherein the first charge-transporting polymer comprises a polymeric reaction product formed by reacting N,N'-diphenyl-N,N'bis (3-hydroxyphenyl)-(1,1'biphenyl)-4,4'diamine with diethylene glycol bischloroformate.

3. The multilayer photoreceptor of claim 1 wherein the second charge-transporting polymer comprises a copolymer formed by reacting N,N'-bis, 3-hydroxyphenyl (1,1'-biphenyl)-4,4'diamine and 4,4'-isopropylidene diphenol with diethylene glycol bischloroformate.

4. The multilayer photoreceptor of claim 1 wherein the average thickness of the first transport layer is in the range from about 5 to about 50 micrometers.

5. The multilayer photoreceptor of claim 1 wherein the average thickness of the second transport layer is in the range from about 1 to about 5 micrometers.

6. A charge transport dual layer comprising:

a first transport layer comprising a first charge-transporting polymer including charge transporting segments and inactive segments, wherein the first charge-transporting polymer comprises a polymeric arylamine compound; and a second transport layer deposited on the first transport layer, the second transport layer comprising a second charge-transporting polymer including charge transporting segments and inactive segments, wherein the second charge-transporting polymer comprises a polymeric arylamine compound;

wherein the weight percent of charge transporting segments in the first charge transporting polymer is in the range from about 30 to about 90 weight percent of the total polymer weight and wherein the weight percent of charge transporting segments in the second charge-transporting polymer is in the range from about 5 to about 30 weight percent of the total polymer weight; and wherein the second transport layer is thinner than the first transport layer.

7. The charge transport dual layer of claim 6 wherein the first charge-transporting polymer comprises a polymeric reaction product formed by reacting N,N'-diphenyl-N,N'bis (3-hydroxyphenyl)-(1,1'biphenyl)-4,4'diamine with diethylene glycol bischloroformate.

8. The charge transport dual layer of claim 6 wherein the average thickness of the first charge transport layer is in the range from about 5 to about 50 micrometers.

9. The charge transport dual layer of claim 6 wherein the average thickness of the second transport layer is in the range from about 1 to about 5 micrometers.

* * * * *

UNITED STATES PATENT AND TRADEMARK OFFICE

CERTIFICATE OF CORRECTION

PATENT NO. : 5,830,614

DATED : 3 November 1998

INVENTOR(S) : Damodar M. PAI et al.

It is certified that error appears in the above-identified patent and that said Letters Patent is hereby corrected as shown below:

| Column | Line | |
|---|---|---|
| 7 | 66 | Change "Vitel PE-200™" to --Vitel PE-200D™--. |
| 14 | 43 | Change "Example VI and VII" to --Examples VI and VII--. |

Signed and Sealed this

Thirteenth Day of July, 1999

*Attest:*

*Attesting Officer*

Q. TODD DICKINSON

*Acting Commissioner of Patents and Trademarks*